US006767264B2

(12) United States Patent
Mercer

(10) Patent No.: US 6,767,264 B2
(45) Date of Patent: Jul. 27, 2004

(54) SPORT BOARD FOOT PAD

(75) Inventor: Joseph R. Mercer, Cardiff, CA (US)

(73) Assignee: Oam, LLC, Oceanside, CA (US)

( * ) Notice: Subject to any disclaimer, the term of this patent is extended or adjusted under 35 U.S.C. 154(b) by 0 days.

(21) Appl. No.: 10/155,160

(22) Filed: May 24, 2002

(65) Prior Publication Data

US 2003/0124923 A1 Jul. 3, 2003

Related U.S. Application Data

(60) Provisional application No. 60/345,218, filed on Jan. 3, 2002.

(51) Int. Cl.[7] ..... B63B 1/00
(52) U.S. Cl. ..... 441/65; 441/74
(58) Field of Search ..... 441/65, 74, 77, 441/79, 68

(56) References Cited

U.S. PATENT DOCUMENTS

| | | | | |
|---|---|---|---|---|
| 4,285,082 A | * | 8/1981 | Cox | 441/74 |
| 4,871,337 A | | 10/1989 | Harris | |
| 4,902,256 A | | 2/1990 | Berglund | 441/68 |
| 5,460,558 A | | 10/1995 | Woodstock | 441/74 |
| 5,499,836 A | | 3/1996 | Juhasz | |
| 5,529,523 A | | 6/1996 | Wilhelmi | 441/74 |
| 5,625,964 A | | 5/1997 | Lyden et al. | 36/29 |
| 5,638,612 A | | 6/1997 | Douzis | 36/29 |
| 5,679,039 A | | 10/1997 | Robles | |
| 5,704,137 A | | 1/1998 | Dean et al. | 36/28 |
| 5,766,051 A | | 6/1998 | Messer | 441/65 |
| 5,910,035 A | | 6/1999 | Rebotier | 441/74 |
| 5,930,918 A | | 8/1999 | Healy et al. | 36/29 |
| 5,947,781 A | | 9/1999 | VonWald et al. | |
| 5,987,780 A | | 11/1999 | Lyden et al. | 36/29 |
| 6,082,025 A | | 7/2000 | Bonk et al. | 36/29 |
| 6,158,149 A | | 12/2000 | Rudy | 36/29 |
| 6,258,421 B1 | | 7/2001 | Potter | 428/35.2 |

FOREIGN PATENT DOCUMENTS

DE 100 40 775 A 1 3/2002

* cited by examiner

*Primary Examiner*—Stephen Avila
(74) *Attorney, Agent, or Firm*—Kenneth J. Hovet

(57) ABSTRACT

A foot traction pad is provided for a sport board having a built-in arch. The arch is constructed of a bladder containing a fluid that will move and conform to a user's foot and continue conformance whenever there is foot movement. The bladder underlies and attaches to a pad covering. Extending upwardly from the plane of the pad is a foot abutment structure. The structure is spaced-apart from the rear end of the bladder and may include one or more small bladders. The abutment structure is aligned laterally in relation to the longitudinal axis of the bladder. The pad covering overlies the abutment structure. The pad may be an integrated unitary body or it may have peripheral segments for accommodating different sport board sizes and shapes.

23 Claims, 8 Drawing Sheets

SPORT BOARD FOOT PAD

The present invention claims priority of Provisional Application No. 60/345,218 filed Jan. 3, 2002.

BACKGROUND OF THE INVENTION

1. Field of the Invention

The present invention pertains generally to cushioned foot pads. More particularly, the invention concerns a foot pad for a sport board that increases foot stability and facilitates maneuvering.

2. Description of Related Art

Surfers and related sport board users are oftentimes confronted with difficult conditions such as choppy water, large waves, high winds and uneven terrain. In order to control one's board, there must be an effective connection between the board and a user's feet. In some board sports, bindings have been used to lock one's feet to the board. However, bindings restrict foot movements that are needed to maintain a proper center of balance during board maneuvers. Unrestrictive means for foot control comprise wax or grit coatings on the top of a board. Other means are ribbed pads, tapered pads, and pads with foot retention cavities.

In U.S. Pat. No. 5,529,523, a longitudinally extending V-shaped channel is used to provide a foot bearing means. However, the open channel provides only minimal leverage and is not effective when making sharp turns.

A wedge-shaped pad that extends laterally across a board is shown and described in U.S. Pat. No. 5,910,035. This device provides asymmetric foot leverage in one direction only. Therefore, it has only limited usefulness.

A pad that tapers gradually from a thin inner edge to a thick edge adjacent the front nose of a wakeboard, is shown in U.S. Pat. No. 5,766,051. This pad also discloses a longitudinally tapering offset arch support with concavities for the ball and heel areas of a foot. Problems with this design is that it is foot specific. Therefore, usefulness is limited. Additionally, the gradual tapering presents too much of a thickened area that unnaturally shifts a user's center of balance. This construction hinders, rather than helps, board control. Also, the gradual taper does not provide a positive abutment for preventing a user's foot from slipping off the edge of the pad.

In U.S. Pat. No. 5,460,558, a foot saddle is disclosed that provides a strong abutment for a user's foot when making rapid turns. The saddle resolves the problem of a foot slipping off the back end of a board. However, it provides no other means for controlling foot slippage because it has no underlying traction pad nor is there any mention of a stabilizing arch support.

SUMMARY OF THE INVENTION

The present invention overcomes numerous deficiencies of the prior art by providing a foot pad having at least one fluid-filled compressible member for an arch support. The compressible member comprises a sealed enclosure that permits fluid movement within the enclosure interior. Fluid movement occurs when a user imparts downward pressure to the enclosure by placement of a foot onto the enclosure. This action causes the enclosure wall to move and conform to the varying contours of a user's foot. A contoured connection to the board is thereby achieved which significantly stabilizes foot position. Such stabilization, in turn, greatly enhances control of the board through every type of maneuver or ambient condition.

The pad may comprise an overall single piece unit or it may be segmented to permit variations in size and shape. The pad may include a foot abutment structure which may also incorporate one or more fluid-filled compressible members.

BRIEF DESCRIPTION OF THE DRAWINGS

The novel features of this invention will be best understood from the accompanying drawings, taken in conjunction with the description below, in which similar characters refer to similar parts, and in which.

DESCRIPTION OF THE PREFERRED EMBODIMENTS

Figure 1:
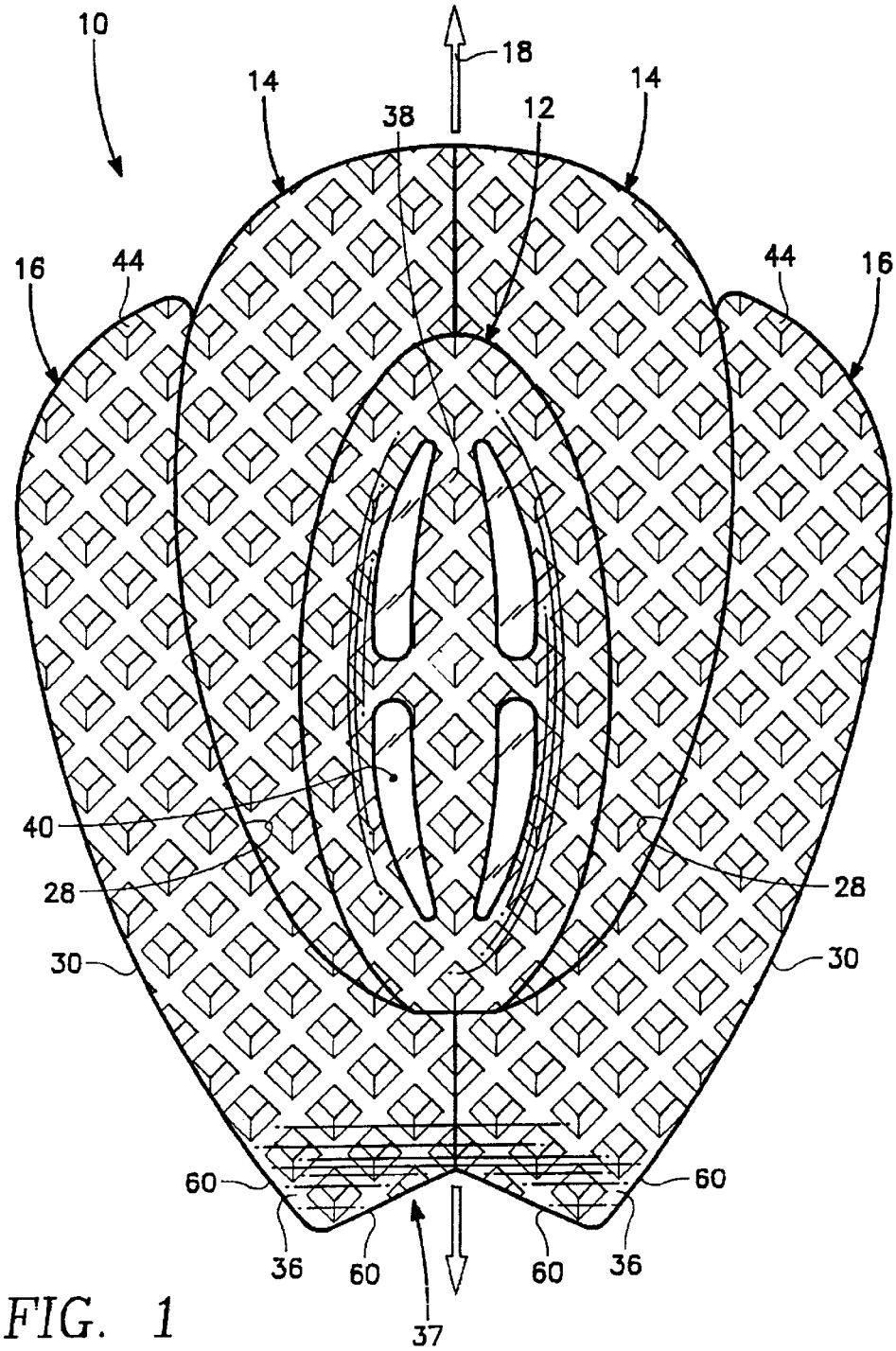
FIG. 1 is a top plan view of the foot pad of the present invention.
Figure 2:
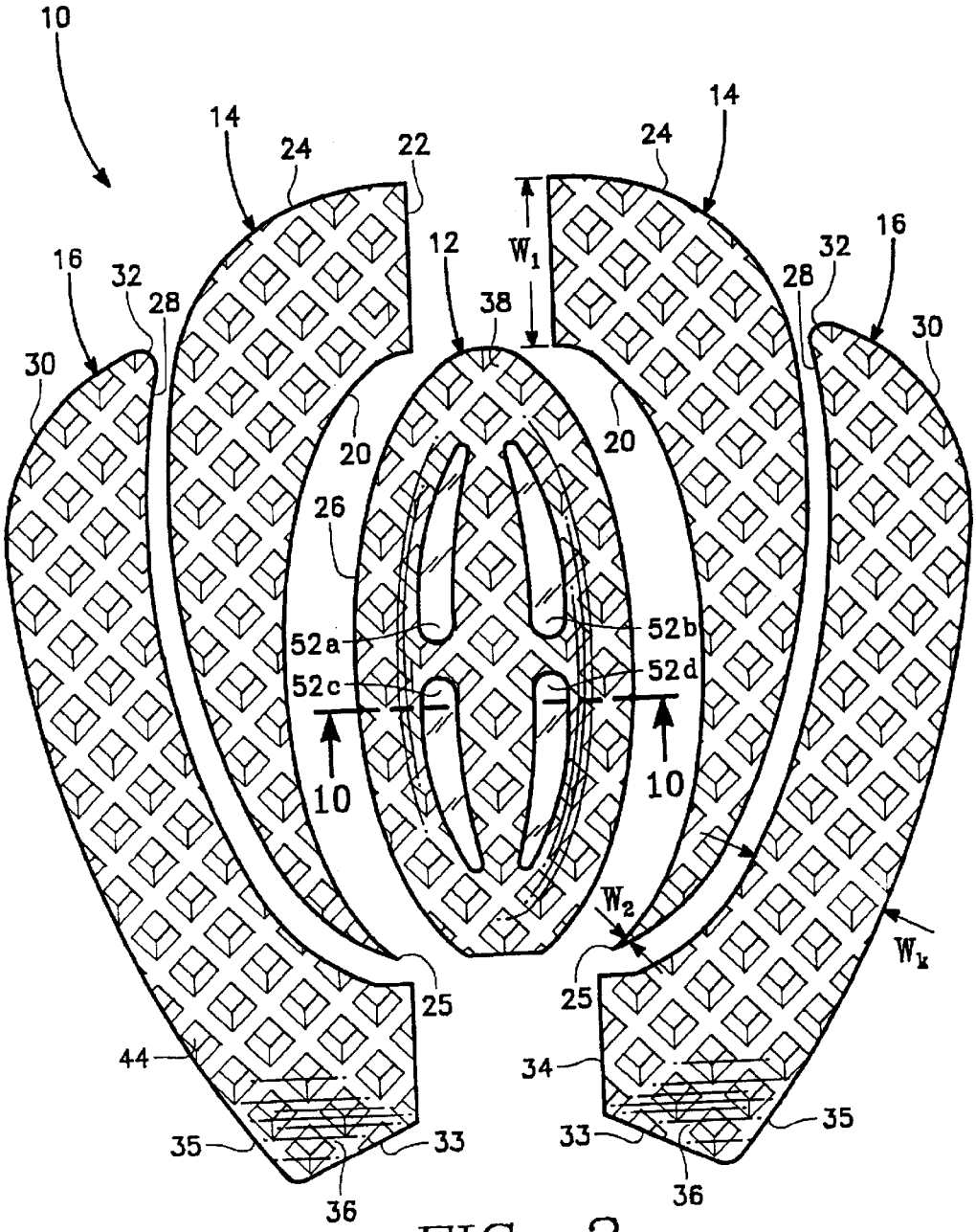
FIG. 2 is top plan view of the foot pad of FIG. 1 showing sections thereof broken apart.

Referring now to FIGS. 1 and 2 of the drawings, the foot pad of the present invention is shown and designated generally by reference 10. In brief overview, the pad comprises a substantially oval shaped arch section 12, a pair of mirror image curved middle sections 14, 14 that enclose the arch section and a pair of mirror image curved kick sections 16, 16 that flank the middle sections 14, 14. The arch section, middle sections and kick sections combine to produce an overall pad assembly having features unlike any other sport board foot pad.

Figure 5:
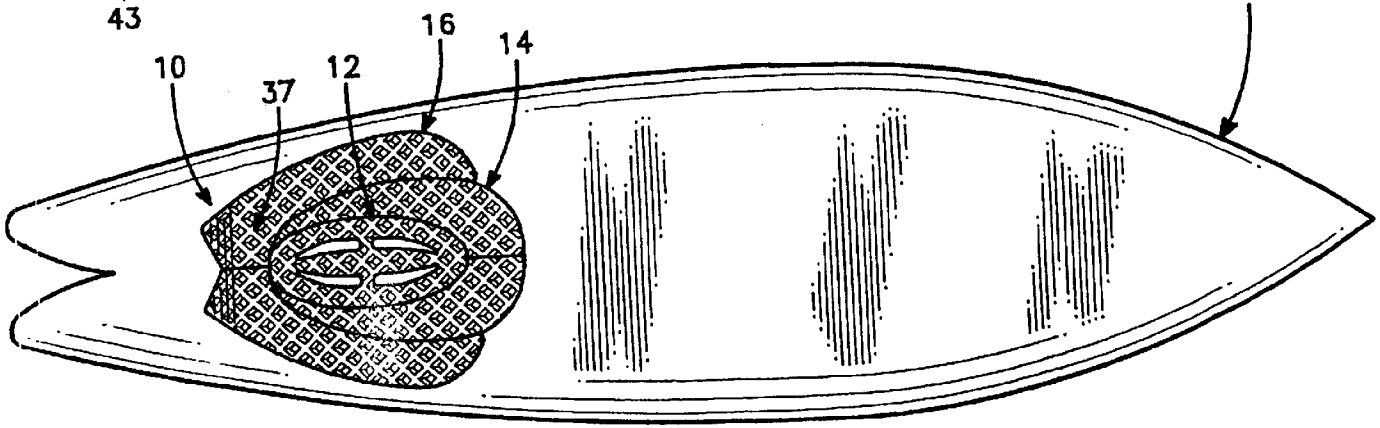
FIG. 5 is top plan view of the foot pad of FIG. 1 attached to the top surface of a surfboard.

The overall pad 10 is preferably symmetrically oriented about a center axis 18 and the major axis of the oval arch is positioned to be coincident with pad center axis 18. As best seen in FIG. 5, when the pad is attached to surfboard 19, center axis 18 is preferably aligned to be coextensive with the centerline longitudinal axis of the surfboard. It will be appreciated, however, that the traction pad could also be aligned angularly in relation to the board centerline and/or it may be placed at an offset location from the board centerline. As used herein, the term "sport board" comprehends a surfboard, wakeboard, skateboard, boogie board and sail board. The term also comprehends, boat decks or other structures wherein increased foot traction is desired. Conversely, use of the term "board" or "surfboard" is meant to comprehend any sport board.

Figure 18:
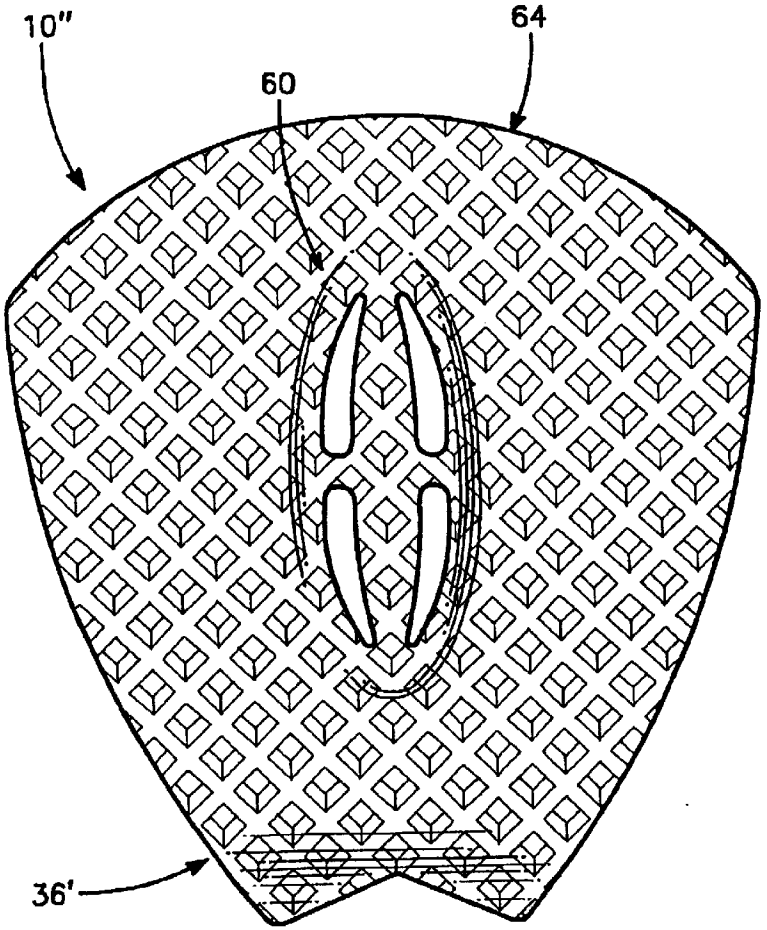
FIG. 18 is a top plan view of an alternative mono-pad with no sectional parts.
Figure 16:
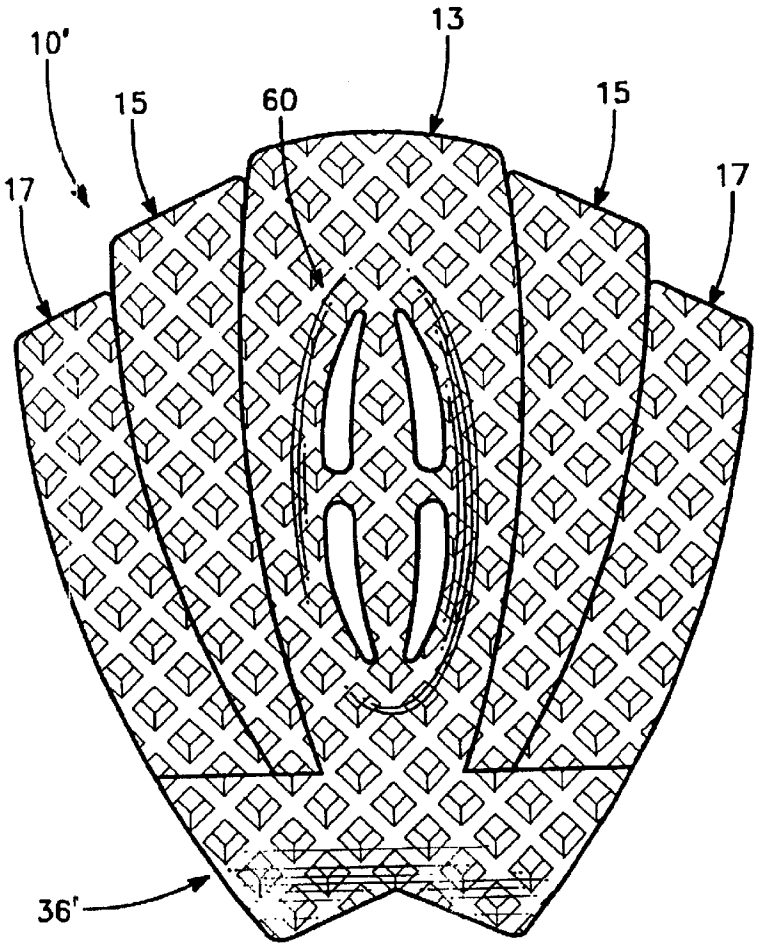
FIG. 16 is a top plan view of an alternative pad having different sectional parts with an arch section combined with an integrated kick structure.

As mentioned, the pad may be a mono-pad comprising a single overall unit as shown in FIG. 18 or it may comprise an assembly of sections as shown in FIGS. 1 and 16. Either way, for attachment to the upper surface of a sport board, the underside of the pad is provided with an adhesive coating 42. The coating is protected with a backing sheet 43 which is removed prior to placement of the pad (or sections) to the sport board in a manner known in the art.

The arch section comprises an arch bladder 40 that is overlaid with an arch covering 38. The covering generally assumes a convex configuration corresponding to the bladder shape. The bladder may have a spherical, tubular, oblong or toroidal shape depending on its specific purpose and position in the pad. It should be constructed of a flexible fluid impervious material such as elastic polymers and rubber compounds. The bladder should have sufficient wall strength to avoid rupture when subjected to dynamic forces during use.

Figure 6:
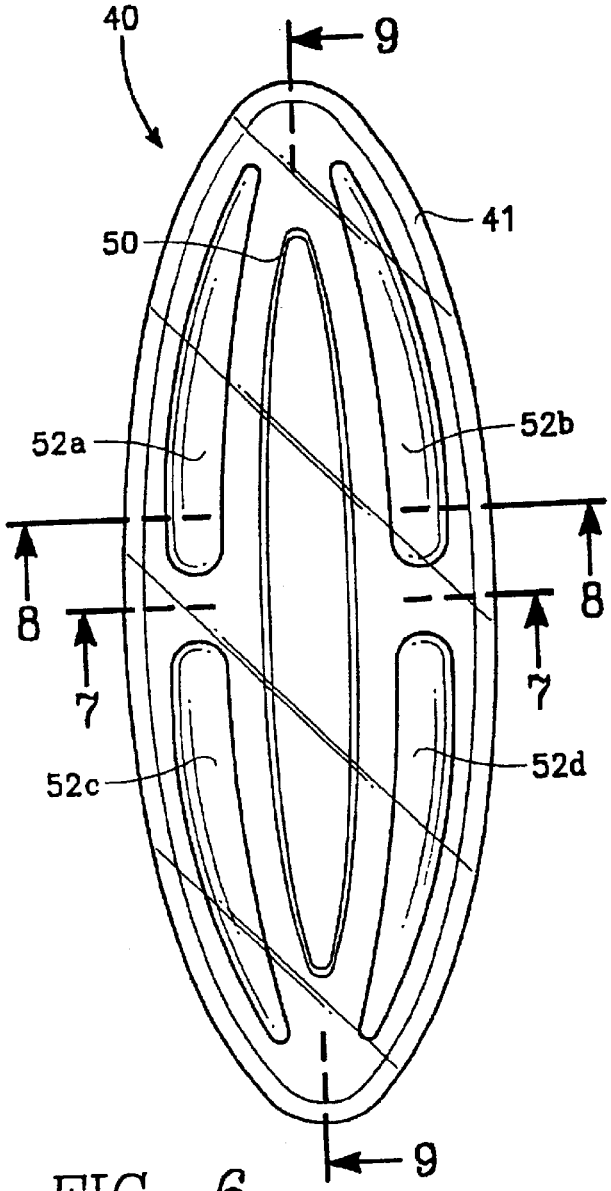
FIG. 6 is top plan view of the arch bladder of the foot pad of FIG. 1

The bladder interior may be open or include support walls. The interior should have sufficient fluid to avoid collapse when stepped upon and used during sport board maneuvers. As shown in FIG. 6, the bladder 40 has an oblong shape providing an oval outline. The outline is defined by a peripheral margin 41.

To secure the bladder in place, the arch covering underside may have an adhesive to which the bladder will adhere. Additionally, the arch covering includes a skirt portion 39 that extends beyond the arch bladder margin 41. The skirt portion underside is also provided with an adhesive so that the bladder margin will be secured to the skirt portion and the entire bladder will be enclosed and secured to the upper surface of a surfboard during the pad attachment process.

The arch covering may be provided with one or more openings to reveal the underlying arch bladder. As shown, two mirror-image pairs of elongated openings 54 *a–d* are formed in the arch covering that expose corresponding upraised portions 52 *a–d* of the arch bladder. It is expected that the bladder may have other protuberances or other predetermined contours as dictated by end use design needs. The bladder may be clear or have a color that contrasts with the pad covering color to provide a striking aesthetically pleasing appearance. Alternatively, the fluid in the bladder may be colored and/or incorporate reflective particles to create an interesting effect.

With reference to FIGS. 6–10, bladder 40 comprises a sealed enclosure having a flexible outer wall 49. The enclosure interior midportion has two longitudinally extending inner walls 50. The inner walls are sealed to the enclosure interior surfaces and are spaced-apart to define a center chamber 46. The interior areas on the outboard side of each inner wall 50 are referenced as outboard chambers 48.

Figure 9:
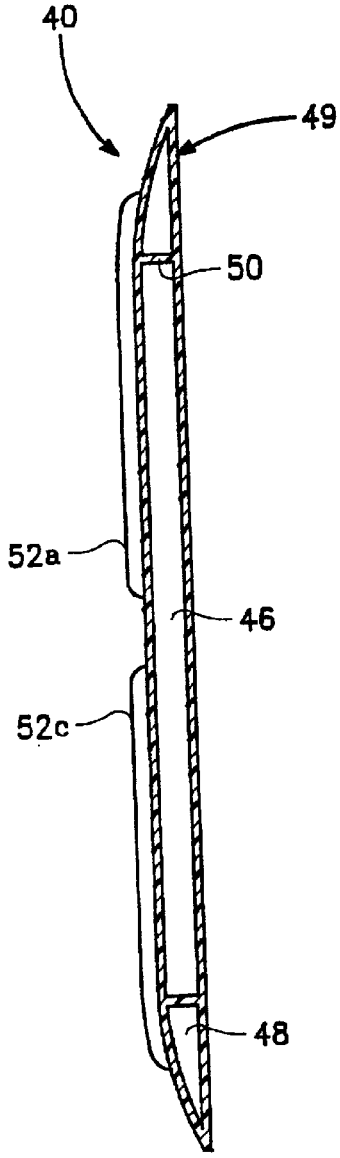
FIG. 9 is a cross-sectional view taken along lines 9—9 in FIG. 6.
Figure 7:
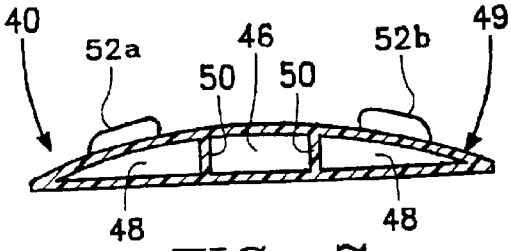
FIG. 7 is a cross-sectional view taken along lines 7—7 in FIG. 6.
Figure 8:
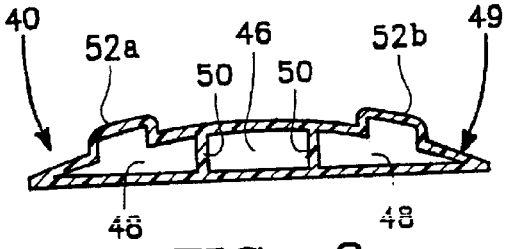
FIG. 8 is a cross-sectional view taken along lines 8—8 in FIG. 6.
Figure 10:
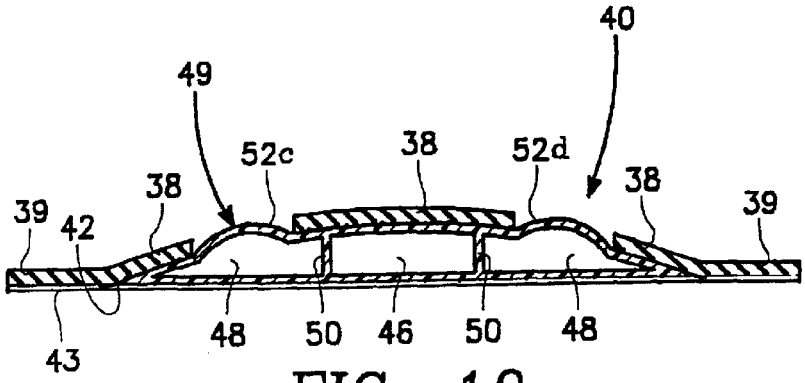
FIG. 10 is a cross-sectional view taken along lines 10—10 of FIG. 2.

As best seen in FIG. 6, the opposing ends of the inner walls are joined together to form an oval-shaped center chamber. The outboard chambers circumscribe the center chamber and provide a continuous open channel around the center chamber. The aforementioned upraised portions 52 *a–d*, extend upwardly from fore and aft areas of the outboard chamber, as best seen in FIGS. 7–9. The upraised portions, center chamber 46 and outboard chambers 48 are symmetrically oriented about center axis 18.

The center chamber 46 and outboard chamber 48 are preferably filled with air. However, other fluid mediums, such as water, viscous solutions, gels, and the like are also envisioned and are considered within the scope of the present invention. When air is used, it is preferred to inflate the bladder to a pressure range of about 10–50 psi.

The middle sections each include a respective curved inner edge 20 with a curvature that corresponds to the oval shape of arch section 12. The curved inner edge 20 merges into a straight forward edge 22. Straight forward edge 22 extends into an arcuate outer edge 24 that is spaced-apart from curved inner edge 20 at the forward portion of the middle section, as best seen in FIGS. 1, 2 and 5. At the rear of each middle section, arcuate outer edge 24 directly merges into curved inner edge 20. With this configuration, the width of the middle section has a decreasing taper from a maximum width $w_1$ at straight forward edge 22, to a minimum width $w_2$ immediately proximate the rear tip 25 of the middle section. This gives the middle section a somewhat crescentic overall profile when viewed in top plan.

When positioned around arch section 12, the middle sections 14, 14 are symmetrically oriented about pad center axis 18 and the straight forward edges 22, 22 are coextensive with center axis 18. When in this position, the curved inner edges 20, 20 of the middle sections contact perimeter edge 26 of the arch, and the middle sections essentially surround the arch.

The kick sections 16, 16 both have a curved inner kick edge 28 with a shape corresponding to the arcuate outer edge 24 of the middle section. The curved inner kick edge 28 merges into rounded outer kick edge 30 at forward tip 32 of the kick section. Proceeding rearwardly from the forward tip, each kick section has a width $w_k$ which initially increases from a minimum width near forward tip 32, than remains at a substantially uniform width along the midportion of the kick section.

At the rear portions of each respective kick section, the curved inner kick edge 28 merges into a straight rear edge 34. The straight rear edge extends rearwardly in a line coincident with center axis 18. It then terminates at tail edge 31 which inclines outwardly until it merges with outer kick edge 30. The rear corner portion outlined by the above edges, defines a half kick structure 36 having a tail face 33 and outer face 35.

When assembled, the kick sections 16,16 are oriented symmetrically about center axis 18 so that straight rear edges 34, 34 are coincident with center axis 18. When this occurs, the curved inner kick edge 28 of each kick section contacts a respective arcuate outer edge 24 of middle section 14. The overall length of the kick section is sufficient to extend at least halfway around a respective arcuate outer edge of the middle section. Once assembled, the half-kick sections 16, 16 along with their respective half kick structures 36, 36 combine to establish the overall kick area 37.

Figure 3:
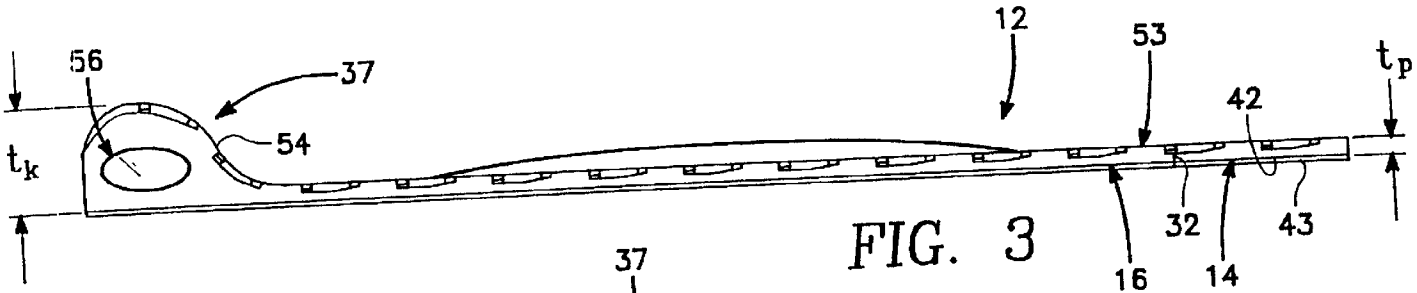
FIG. 3 is a side elevational view of the foot pad of FIG. 1.
Figure 4:
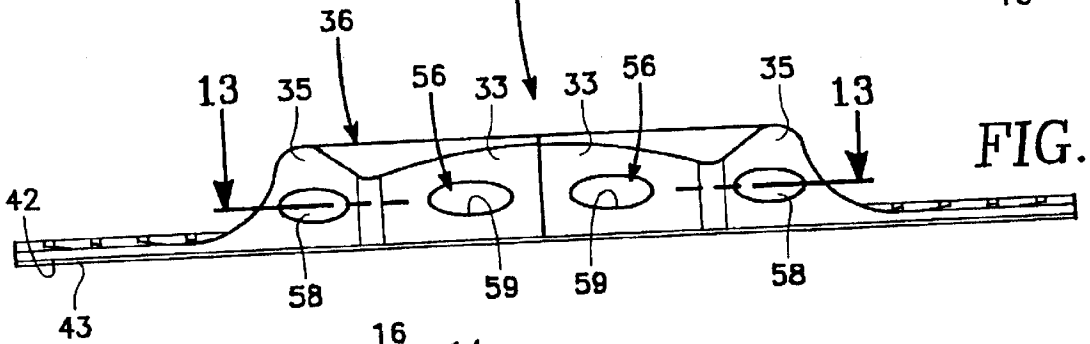
FIG. 4 is a rear elevational view of the foot pad of FIG. 1.

By referring to FIG. 3, it can be seen that over half of the pad has a uniform thickness $t_p$. However, the thickness increases at least two, and preferably four or more times as the rear portion of the kick section merges into rear kickwall 54 of the aforementioned half-kick structure 36. At the curved top portion of the structure, the thickness is referenced as $t_k$ which is about six times the $t_p$ thickness. This increased thickness accommodates the placement and securement of kick bladders 56 in the half-kick structures. It also elevates the rear upstanding kick wall 54 to provide an effective abutment means for a user's foot.

Figure 13:
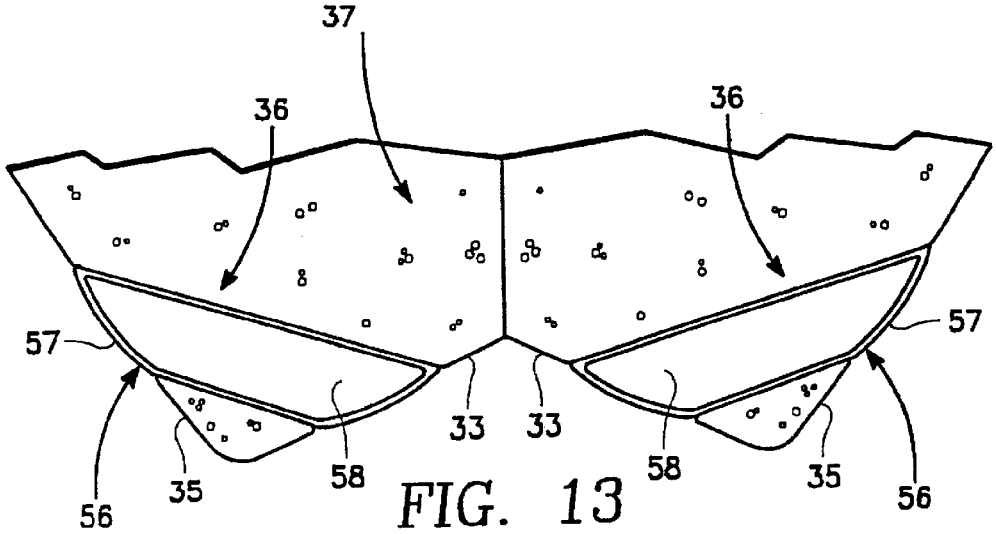
FIG. 13 is a fragmentary cross-sectional view taken along lines 13—13 in FIG. 4.

Each kick bladder 56 comprises an enclosed kick bladder wall 57 that defines an interior kick chamber 58 (See FIG. 13). The kick bladder 56 is fixed within an elongated aperture 59 that extends through the mid-portion of the half-kick structure from tail face 33 to outer face 35. The chamber will contain the previously described fluid to provide a cushioning effect along the length of the bladder. Such effect is enhanced as the kick structure itself has a curved cross-section, as shown, and is constructed of a resilient material such as foamed rubber, EVA or other polymer materials.

Figure 14:
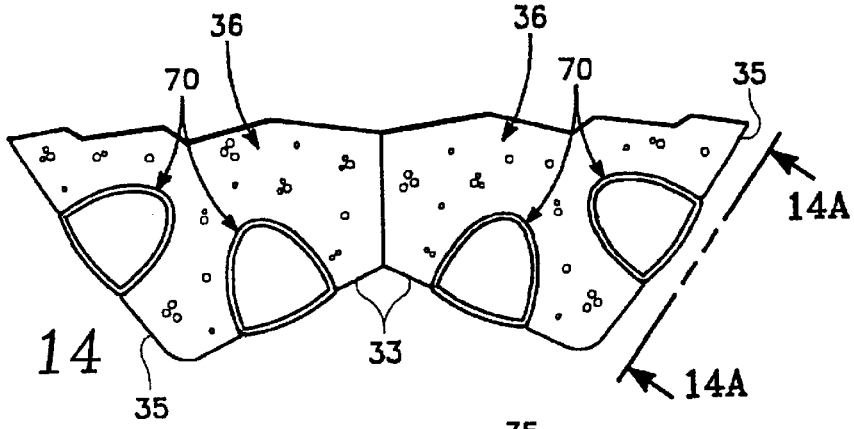
FIG. 14 is a fragmentary cross-sectional view similar to FIG. 13 showing an alternative pocket bladder in the kick structures.
Figure 14A:
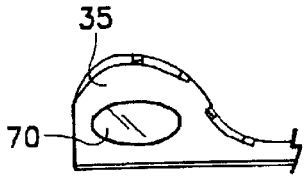
FIG. 14A is an elevational view taken along line 14A in FIG. 14.

Alternative kick bladders and bladder orientations within the kick structures are depicted in FIGS. 14, 14A, 15 and 15A. In FIGS. 14 and 14A, a pocket enclosure 70 extends inwardly from each of the tail faces 33 and outer faces 35. The enclosures may be inserted into preformed openings in the kick structure and secured therein by adhesives. Alternatively, the enclosures may be integrated into the kick structure during the manufacturing process.

The length of the pocket enclosures 70 should not exceed the width of the half kick structure 36 and the long axis of each enclosure is about perpendicular to each respective outer face 35. The enclosures function to provide an enhanced cushioning effect. They also lighten the weight of the pad when air is used as the interior fluid.

Figure 15A:
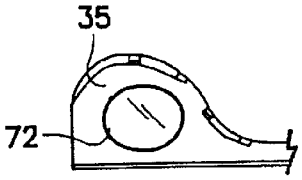
FIG. 15A is an elevational view taken along line 15A in FIG. 15.
Figure 15:
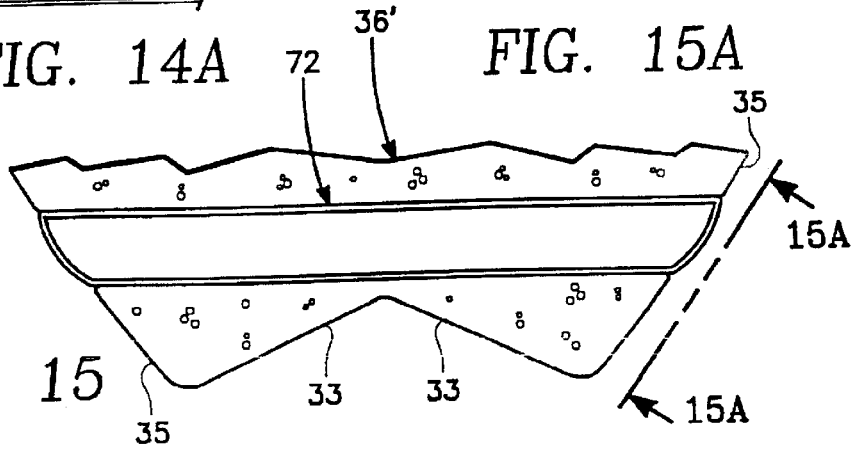
FIG. 15 is a cross-sectional view similar to FIG. 14 showing an integrated kick structure with an alternative tubular bladder.

In FIGS. 15 and 15A, an elongated tubular enclosure 72 is shown that extends across the length of unitary kick structure 36'. The unitary kick structure is shown in the alternative embodiments discussed below with reference to FIGS. 16–18. The tubular enclosure is aligned about parallel with the unitary kick structure longitudinal axis and may interconnect opposing outer faces 33. The diameter of the tubular enclosure should be less than the average width of the kick structure. It may fit within a preformed aperture extending across the kick structure or it may be formed integral with the kick structure during the manufacturing process.

The traction pad arch covering and overall pad body comprise a durable flexible material 53 creating the aforementioned overall thickness $t_p$. The material is preferably made of an expanded vinyl acetate (EVA) material. However, neoprene rubber, polymer resins and other similar types of flexible materials could be used. The upper surface of the pad body is provided with raised protuberances 44 which are arranged in a grid-like pattern to provide increased traction for the user during operation. It is to be appreciated, however, that other shapes and types of protuberances could be used. The pad underside is preferably smooth and is coated with an adhesive 42 as previously described.

Figure 17:
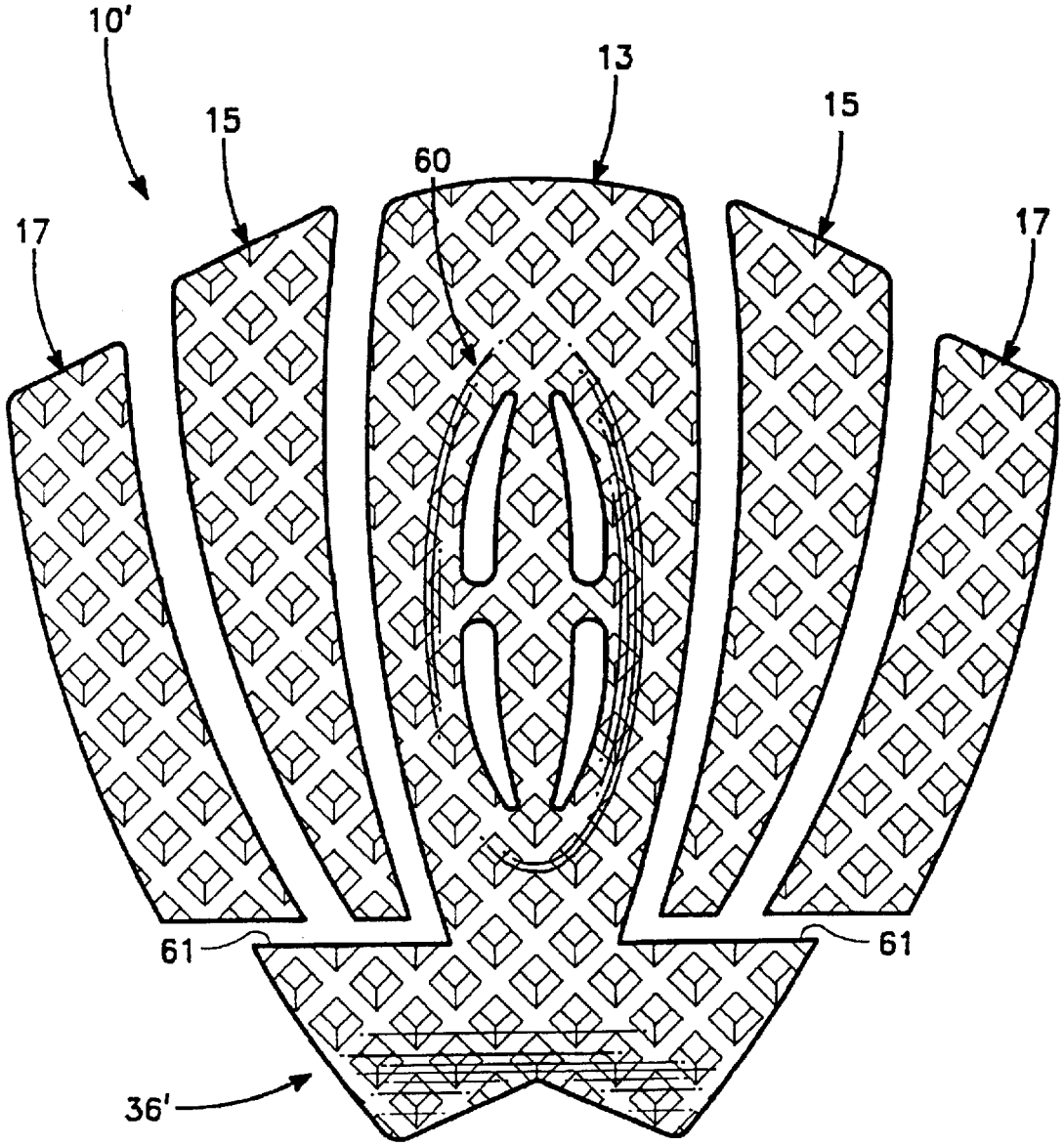
FIG. 17 is a top plan view of the pad shown in FIG. 16 with the sectional parts broken away.

FIGS. 16–17 illustrate an alternative side sectional pad 10' having a center section 13 with opposing interior sections 15, 15 fitted adjacent respective side edges of the center section. Placed adjacent respective outer edges of the interior sections are opposing side sections 17,17.

The center section somewhat resembles an inverted T and comprises a bladder central area 60 that is integral with unitary kick structure 36'. The bottom area of each of the interior sections and side sections are truncated to define a combined coextensive bottom edge that fits against a corresponding upper edge 61 of the unitary kick structure 36'. The location of bladder 40 in the central area 60 and the end elevational profiles of pad 10', are similar to the pad 10 shown in FIG. 1.

FIG. 18 presents a simplified version of the invention comprising the aforementioned non-sectioned mono-pad 10". The plan and elevational views of this pad are similar to the pads shown in FIGS. 1 and 16. The mono-pad is easier to install on a sport board. Also, it permits greater versatility in the placement and angular orientation of bladder 40. In such case, the bladder area 60 may be spaced-apart from center axis 18 or it may be moved axially relative to the kick structure or it may be aligned angularly relative to the center axis.

It will be appreciated that more than one bladder may be used in this embodiment, and in any of the other embodiments described above, to form an arch section 12 or bladder area 60. Still further, it can be seen that more than one foot pad may be applied to a board to accommodate both feet of a user. Alternatively, more than one arch section may be incorporated into a foot pad at selected positions and orientations. For example, if an elongated foot pad is provided to accommodate both feet of a user, more than one arch section may be located in the pad.

Figure 11:
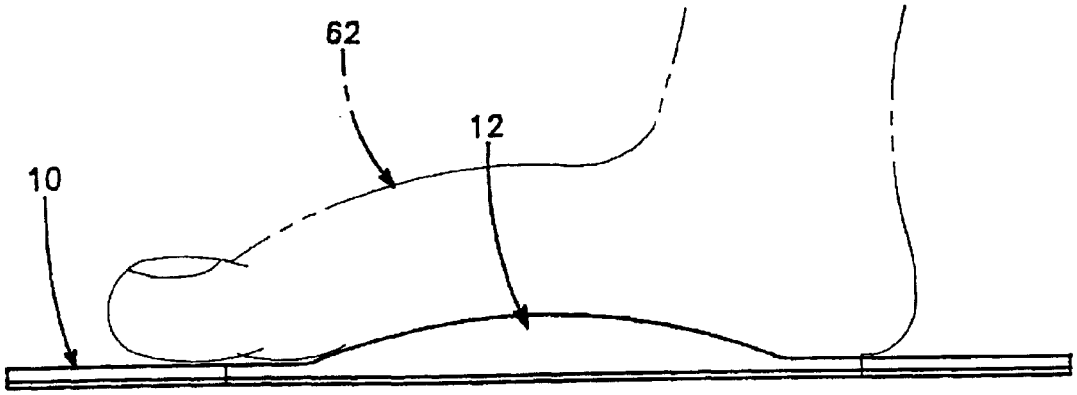
FIG. 11 is a front elevational schematic view of the foot pad of FIG. 1 illustrating the manner in which a user's foot laterally engages the foot pad during operation.
Figure 12:
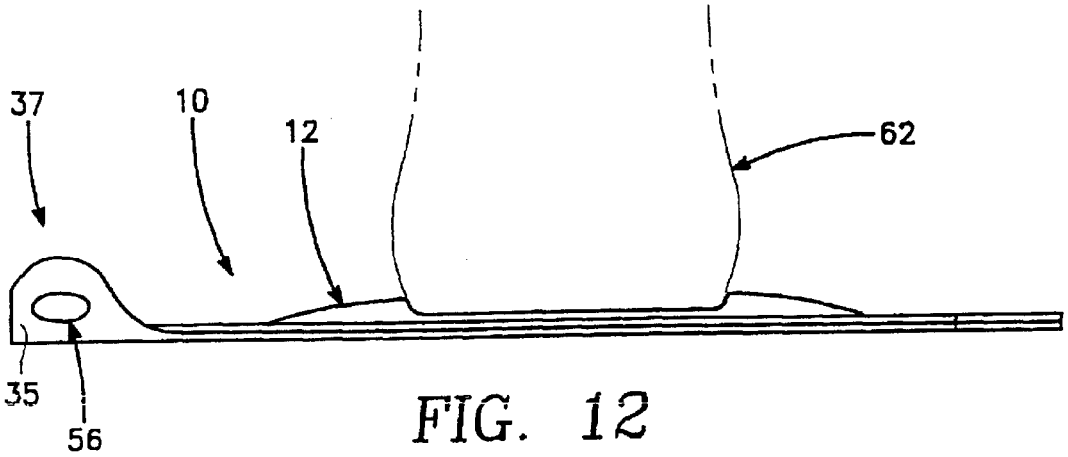
FIG. 12 is a side elevational schematic view of the foot pad and foot of FIG. 11.

In operation, and referring now primarily to FIGS. 11 and 12, the user places a first foot 62 laterally across arch section 12. The other foot is moved across the board as needed to maintain balance. The fluid-filled arch bladder will then yield to allow the pad to conform to the shape of the first foot. This provides a strong stable connection to the sport board. It also provides shock absorption under the user's foot as compared to conventional semi-rigid arch supports.

During maneuvers, the arch bladder allows the user to more readily roll his or her ankle. This permits a smoother transition of the user's weight and facilitates quick turns of the board. Likewise, the steeply inclined shape of the kick structure creates a positive abutment against which a user can push strongly without concern about the foot slipping off the tail of the board. It will also be appreciated that the bladders enhance buoyancy when the pad is used with water craft products such as surfboards. They also lessen the weight of the overall pad as compared to prior art foot pads.

While the foot pads shown and disclosed herein are fully capable of obtaining the objects and providing the advantages above stated, it is to be understood that the presently preferred embodiments are merely illustrative of the invention and no limitations are intended therefor.

I claim:

1. A surfboard having an upper surface with a front portion and a tail portion comprising:

at least one foot traction pad attached to said upper surface of said tail portion;

said pad comprising a covering with an underside;

at least one arch support comprising a compressible member being attached to said underside, said arch support extending upwardly from said pad: and, said pad including at least one foot abutment member which extends upwardly from said pad a distance greater than said arch support.

2. The surfboard of claim 1 wherein said surfboard has a board longitudinal axis and said arch support has an arch longitudinal axis which is about coextensive with, or parallel to, said board longitudinal axis.

3. The surfboard of claim 1 wherein said tail portion terminates at a tail, said foot abutment member being located between said arch support and said tail.

4. The surfboard of claim 3 wherein said pad comprises at least one arch support section having a periphery; and, two or more segments that are located adjacent at least portions of said periphery.

5. The surfboard of claim 1 wherein said foot abutment member includes at least one compressible member.

6. In a sport board upon which is mounted a foot pad wherein the improvement comprises:

said foot pad comprising a traction covering having an arch support section from which extends at least one raised arch area, said arch area including at least one enclosure containing a compressible material, said foot pad including at least one raised foot abutment structure that is spaced-apart from said arch area.

7. The sport board of claim 6 wherein said compressible material is any one or combination of members selected from the group consisting of resilient material, foamed rubber, EVA, and polymer materials, air, gas, liquid and gel.

8. The sport board of claim 7 wherein said compressible material contains any one or more of a member selected from the group consisting of particles, flakes, bubbles and colorants.

9. The sport board of claim 6 wherein said enclosure is defined by enclosure walls having one or more protuberances.

10. The sport board of claim 6 wherein said enclosure has an interior defined by enclosure walls, said enclosure walls being supported by one or more inner walls within said interior.

11. The sport board of claim 6 wherein said foot pad has a center axis and said enclosure has an arch longitudinal axis that is about coexistensive with said center axis.

12. The sport board of claim 6 wherein said covering has a predetermined thickness and said foot abutment structure has a thickness that is at least twice said pre-determined thickness.

13. The sport board of claim 12 wherein said foot abutment structure includes one or more compressible members.

14. The sport board of claim 6 wherein said covering comprises at least one or more pad sections that interfit with each other and with said arch support section to form a continuous pad surface.

15. The sport board of claim 14 wherein said covering includes at least one raised foot abutment structure and wherein said arch support section is integral with said foot abutment structure.

16. The surfboard of claim 1 wherein said pad has a center axis and said arch support has an arch longitudinal axis that is about parallel to said pad center axis.

17. The surfboard of claim 1 wherein said pad has arch openings, said compressible member underlying said arch openings and being visible through said arch openings.

18. The surfboard of claim 16 including at least one foot abutment member extending upwardly from said pad which is spaced-apart from said arch support a predetermined distance.

19. The surfboard of claim 18 wherein said foot abutment member comprises an elongated structure that extends laterally relative to said arch support.

20. The sport board of claim 14 wherein said foot abutment structure is in at least one of said pad sections.

21. The sport board of claim 14 wherein said compressible material is any one or combination of members selected from the group consisting of foamed rubber, EVA and polymer materials, air, gas, liquid and gel.

22. A surfboard having an upper surface with a front portion and a tail portion comprising:

at least one foot traction pad attached to said upper surface of said tail portion;

said pad comprising a covering with an underside;

at least one arch support comprising a compressible member being attached to said underside; and, said pad having arch openings and said compressible member being visible through said arch openings.

23. In a sportboard upon which is mounted a footpad wherein the improvement comprises:

said footpad comprising a traction covering having an arch support section from which it extends at least one raised arch area, said arch area including at least one enclosure containing a compressible material, said covering comprising at least one or more pad sections that interfit with each other and with said arch support section to form a continuous pad surface.

* * * * *